US005867872A

United States Patent [19]

Katoh

[11] Patent Number: 5,867,872

[45] Date of Patent: Feb. 9, 1999

[54] TILT HINGE

[75] Inventor: Hideo Katoh, Kanagawa, Japan

[73] Assignee: Katoh Electrical Machinery Co., Ltd., Kanagawa, Japan

[21] Appl. No.: 856,471

[22] Filed: May 14, 1997

[30] Foreign Application Priority Data

May 16, 1996 [JP] Japan ..... 8-122085

[51] Int. Cl.[6] ..... E05C 17/64

[52] U.S. Cl. ..... 16/337; 16/354

[58] Field of Search ..... 16/337, 338, 366, 16/340, 354, 82, 85, 50, 378, 303, 330

[56] References Cited

U.S. PATENT DOCUMENTS

| | | | |
|---|---|---|---|
| 833,734 | 10/1906 | Diehl | 16/354 |
| 2,516,935 | 8/1950 | Weaver | 16/354 |
| 4,614,454 | 9/1986 | Kassai | 16/324 |
| 4,916,926 | 4/1990 | Shieh | 16/337 |
| 5,102,084 | 4/1992 | Park | 16/338 |
| 5,269,047 | 12/1993 | Lu | 16/340 |

*Primary Examiner*—Chuck Y. Mah
*Attorney, Agent, or Firm*—Notaro & Michalos P.C.

[57] ABSTRACT

A first rotating shaft supporting an opening-closing body and rotating with the opening and closing operation of the opening-closing body is rotatably mounted on a mounting member attached on an apparatus body side. A first friction mechanism works on the rotating shaft. A main driving gear is mounted on the first rotating shaft so as to rotate together with the first rotating shaft. A second rotating shaft is mounted on the mounting member; on the second rotating shaft a driven gear engaged with the main driving gear is mounted to rotate with the second rotating shaft. Also, on the second rotating shaft a second friction mechanism works. Furthermore, a click stop means works on the first rotating shaft.

8 Claims, 5 Drawing Sheets

TILT HINGE

BACKGROUND OF THE INVENTION

1. Field of the Invention

The present invention relates to a tilt hinge suitable for use for opening and closing various kinds of opening-closing bodies like display bodies, cover bodies, etc. of electronic devices such as televisions, office automation equipment, etc.

2. Description of the Related Art

In this type of conventional tilt hinges, the rotation of a rotating shaft comprised of a tingle shaft which is rotatably mounted on these mounting members is controlled by means of a friction mechanism working on the rotating shaft. In prior arts, there has been no tilt hinge of two-shaft system.

The prior art tilt hinge having a single rotating shaft has the advantage that it can be manufactured at a low cost because of a simple construction. However, when a greater friction is needed, it becomes inevitable to increase a frictional surface area, which will result in an increased device size. This is true especially when simultaneously obtaining the tilt hinge, a great frictional function, and a click stop mechanism. The device, when large in size, is not applicable to an opening-closing device of a small-sized electronic device if the opening-closing body, despite of its small size, requires a great frictional torque and the click stop mechanism. To cope with this disadvantage, it is desired to use a tilt hinge capable of obtaining a great frictional torque, albeit a small size.

SUMMARY OF THE INVENTION

It is an object of the present invention to provide a two-shaft tilt hinge which can easily generate a greater friction despite of its small size than a prior art single-shaft rotating shaft.

It is another object of the present invention to provide a tilt hinge capable of click stopping in addition to the above-described generation of a greater frictional torque despite of its small size than the prior art tilt hinge using a single rotating shaft.

To attain the above-described objects, the tilt hinge of the present invention is so designed that a first rotating shaft which supports an opening-closing body and rotates together with the opening-closing operation of the opening-closing body is rotatably mounted on a mounting member attached on the device body side, so that the first friction mechanism will work upon the first rotating shaft. In the meantime, a main driving gear is mounted on the first rotating shaft in such a manner that the main driving gear will rotate together with the first rotating shaft; a second rotating shaft is mounted to the mounting member; a driven gear engaged with the main driving gear is mounted on the second rotating shaft to rotate together; and on the second rotating shaft a second friction mechanism will work.

In the present invention, the opening-closing body is supported on the mounting member attached on the device body side; and the first rotating shaft which rotates with the opening-closing operation of the opening-closing body is rotatably mounted, so that the first friction mechanism and the click stop means may work on the first rotating shaft. In the meantime the main driving gear is mounted on the first rotating shaft in such a manner that it will rotate together with the rotating shaft; the second rotating shaft is mounted on the mounting member; the driven gear in mesh with the main driving gear is mounted on the second rotating shaft so as to rotate together with the second rotating shaft; and on the second rotating shaft the second friction mechanism works.

Furthermore, the first friction mechanism of the present invention comprises a stationary cam member in which the rotating shaft is rotatably inserted into a bearing hole and fixed on the bearing section of the mounting member, an axially slidable rotating cam member which is in contact with the stationary cam member and mounted on the first rotating shaft so that it will rotate with the first rotating shaft, and an elastic means mounted on the first rotating shaft to push the rotating cam member toward the stationary cam member side.

Next, the second friction mechanism may be comprised of a friction washer in which the second rotating shaft is rotatably inserted into the bearing hole and fixed to the bearing section of the mounting member, and a spring washer which is pressed into contact with the friction washer and mounted on the second rotating shaft to enable rotation together with the rotating shaft and sliding in an axial direction.

Furthermore, the click stop means may be comprised of a recess section provided in the stationary cam member, a projecting section provided in the rotating cam member which fits in the recess section at a specific angle of rotation, and an elastic means for pushing the rotating cam member toward the stationary cam member side.

Furthermore, the main driving gear may be a gear having a non-toothed portion by which the range of engagement of the main driving gear with the driven gear can be restricted to the range of the specific angle of rotation of the main driving gear.

The above and other objects, features and advantages of the present invention will become clearer from the following description with reference to the accompanying drawings.

DESCRIPTION OF THE PREFERRED EMBODIMENTS

Figure 1:
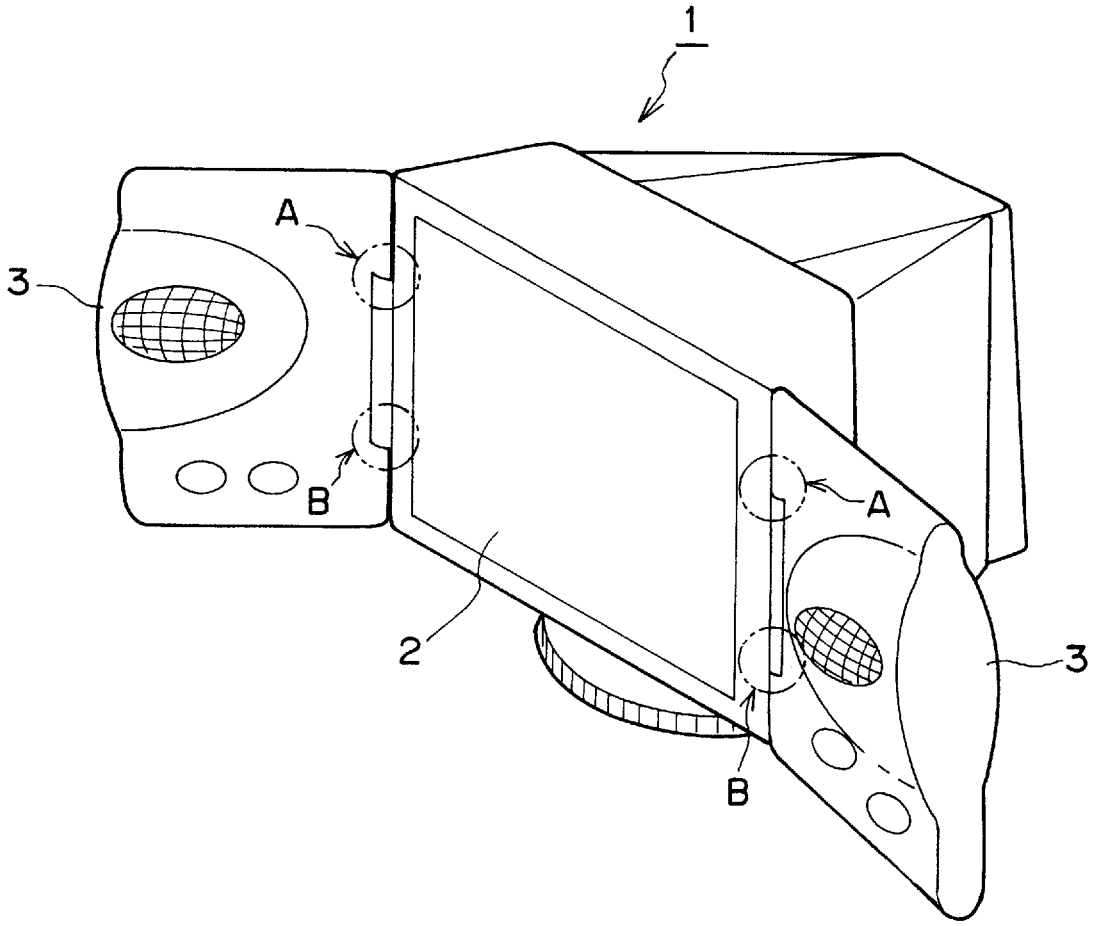
FIG. 1 is a perspective view of a video entertainment system (TV) using a tilt hinge of the present invention.
Figure 2:
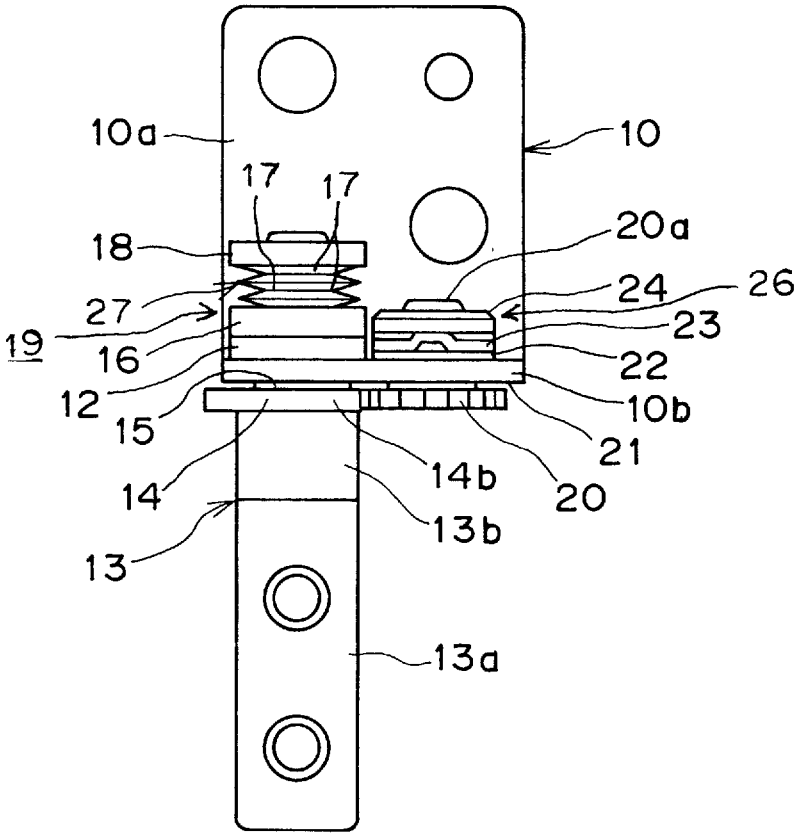
FIG. 2 is a front view of the tilt hinge of the present invention.
Figure 3:
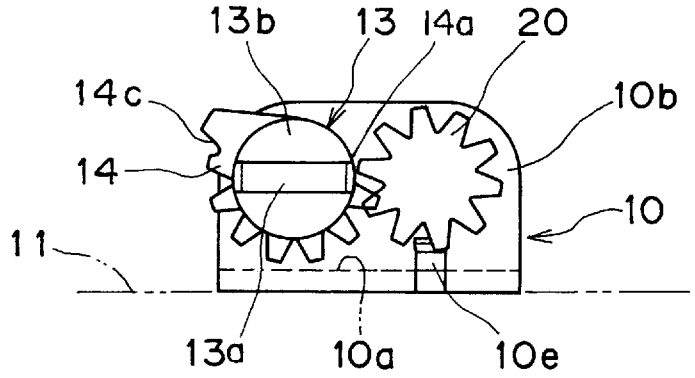
FIG. 3 is a bottom view of the tilt hinge shown in FIG. 2.
Figure 4:
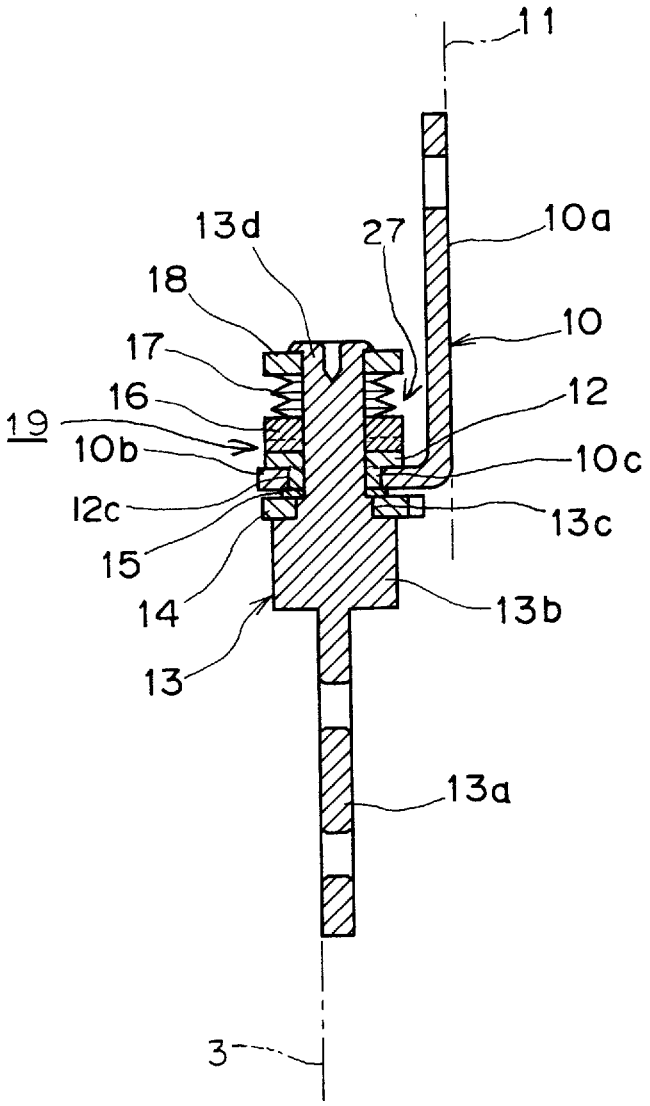
FIG. 4 is a sectional view taken along line A—A of FIG. 2.
Figure 5:
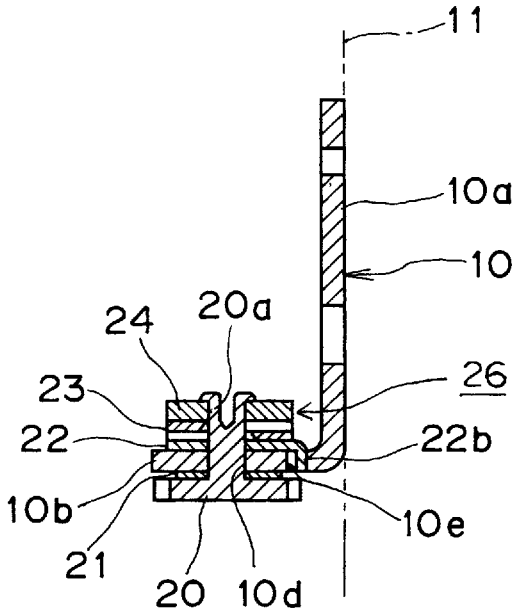
FIG. 5 is a sectional view taken along line B—B in FIG. 2.
Figure 6:
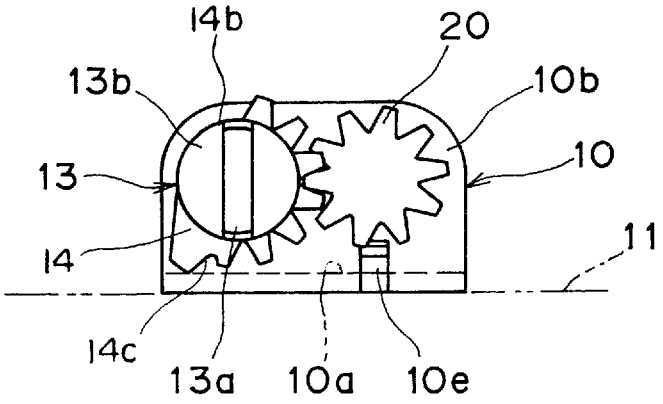
FIG. 6 is a bottom view of the tilt hinge of FIG. 2 with the opening-closing body opened 90 degrees wide.
Figure 7:
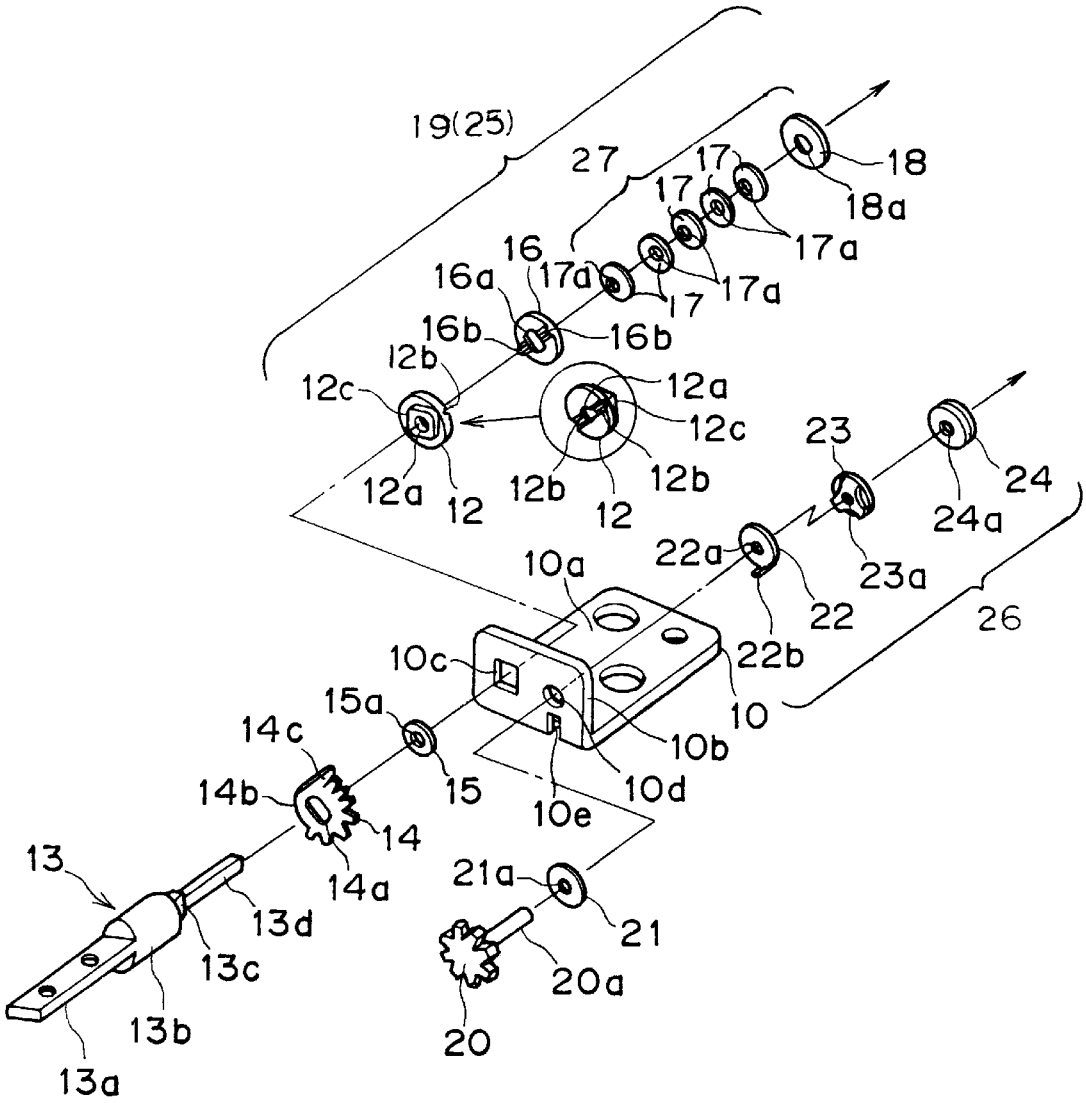
FIG. 7 is an exploded perspective view of the tilt hinge of FIG. 2.

FIG. 1 shows a video entertainment system (TV) using a tilt hinge of the present invention. On both sides of a cathode ray tube 2 of the video entertainment system (TV) body 1 a pair of opening-closing bodies 3, 3 with speakers built in are attached in such a manner that the opening-closing bodies 3, 3 can be swung to open and close horizontally. Four tilt hinges in all are used at positions A and B of the opening-closing bodies 3, 3. It should be noticed that the above-described arrangement of the tilt hinges of the present invention is only one example and may be used for opening and closing an opening-closing body comprising a display body which is openably attached on a keyboard side of, for example, a laptop office automation apparatus.

FIGS. 2 to 7 show details of the tilt hinge of the present invention. In these drawings, 10 denotes a mounting member comprising a mounting section 10*a* having an L-shaped section and a bearing section 10*b*; the mounting section 10*a* being secured on the apparatus body 11 side. In a deformed mounting form 10*c* provided with the bearing section 10*b* of the mounting member 10, a deformed mounting section 12*c* of the stationary cam member 12 which serves also as a bearing member is fixedly fitted. The first rotating shaft 13 has a deformed mounting portion 13*a*, a large-diameter portion 13*b*, a deformed medium-diameter portion 13*c*, and a deformed small-diameter portion 13*d* which are axially arranged, and is rotatably supported, on a bearing, at the deformed small-diameter portion 13*d*, in the bearing hole 12*a* of the stationary cam member 12. A part of this deformed small-diameter portion 13*d* to be inserted in the bearing hole 12*a* may be formed round in section.

Between the large-diameter portion 13*b* of the first rotating shaft 13 and the bearing section 10*b*, the main driving gear 14 having a non-toothed portion 14*b* and the washer 15 are mounted with the deformed medium-diameter portion 13*c* inserted into deformed holes 14*a* and 15*a* provided at the middle section, thereby enabling the main driving gear 14 and the washer 15 to rotate together with the first rotating shaft 13. Next, the rotating cam member 16 is axially slidably mounted, oppositely to the stationary cam member 12, on the deformed small-diameter portion 13*d* of the first rotating shaft 13 so that the rotating cam member 16 will rotate together, while the deformed small-diameter portion 13*d* is being inserted into the deformed hole 16*a* provided at the center portion. The washer 15 may be produced of any of synthetic resin such as nylon, fiber, phosphor bonze, and a metal Such as stainless steel.

On the side of the stationary cam member 12 facing the rotating cam member 16, a pair of recess sections 12*b*, 12*b* arranged radially at an interval of 180 degrees are formed, and on the rotating cam member 16 side also, a pair of projecting sections 16*b*, 16*b* are formed radially at an interval of 180 degrees, oppositely to the recess sections 12*b*, 12*b*. The projecting sections and the recess sections may be provided in reverse positions.

On the deformed small-diameter portion 13*d* of the first rotating shaft 13 are mounted five elastic disk springs 17 in mutually facing positions so as to press the rotating cam member 16 against the stationary cam member 12 side. Furthermore, the deformed small-diameter portion 13*d* is inserted into the insertion hole 17*a* provided at the center thereof. The disk springs 17 are inserted over the deformed small-diameter portion 13*d* through the deformed hole 18*a*, and then are provided with an elastic force by a plain washer 18 mounted by staking to a specific torque at the forward end of the deformed small-diameter portion 13*d*, thereby forming an elastic means 27 to press the rotating cam member 16 against the stationary cam member 12 side. It is to be noted that the number and mounting method of the disk springs are not limited and the disk springs may be replaced with other types of spring washers and springs. Furthermore, a means for mounting the disk springs by staking may be changed to a known means such as nuts, E-rings, lock washers, etc.

On the deformed mounting section 13*a* of the first rotating shaft 13, an opening-closing body 3 closably mounted on the device body 1 shown in FIG. 1 and provided with a built-in speaker is fastened at one end section thereof.

Therefore, when the opening-closing body 3 is in a closed state, the projecting section 16*b* or the rotating cam member 16 fits in the recess section 12*b* of the stationary cam member 12. When the opening-closing body 3 is opened, the rotating cam member 16 turns together with the first rotating shaft 13, releasing the projecting section 16*b* out of the recess section 12*b*. At this time, the rotating cam member 16 slightly slides toward the disk spring 17 side, thereby generating a great friction, by the first friction mechanism 19, at the first rotating shaft 13. When the opening-closing body 3 is closed, the projecting section 16*b* of the rotating cam member 16 goes into the recess section 12*b* of the stationary cam member 12, thus stopping in the closed position. At this time, the click means 25 gives a feeling of click, stabilizing the closed state of the opening-closing body 3. The opening-closing body maybe stopped with stability in an arbitrary opened position by changing the positions of the recess and projecting sections.

The first friction mechanism 19 comprises the stationary cam member 12 secured to the bearing section 10*a* of the mounting member 10, with the first rotating shaft 13 rotatably inserted into the bearing hole 12*a*; an axially slidable rotating cam member 16 which is mounted on the first rotating shaft 13, in contact with the stationary cam member 12, to rotate together with the first rotating shaft 13; and the elastic means 26 composed of a plurality of disk springs 17 attached on the first rotating shaft 13 to push the rotating cam member 16 toward the stationary cam member 12 side. The click stop means 25 further comprises the recess section 12*b* provided in the stationary cam member 12 and the projecting section 16*b* provided on the rotating cam member 16 in addition to the first friction mechanism 19 mentioned above.

Next, in the bearing section 10*b* of the mounting member 10, the second rotating shaft 20*a* is rotatably inserted into the bearing hole 10*d* provided in a position apart from the location of the first rotating shaft 13. On one end of this second rotating shaft 20*a* the driven gear is integrally formed. Between the driven gear 20 and the bearing section 10*b* a washer 21 is interposed and the second rotating shaft 20*a* is inserted into an insertion hole 21*a* provided in the center of the washer 21, and further on the other side of the bearing section 10*b* opposite to the side where the washer 21 is mounted, there is mounted a friction washer 22 produced of for instance phosphor bronze, with the second rotating shaft 20*a* inserted into an insertion hole 22*a* provided in the center of the friction washer 22. The friction washer 22 is fixed non-rotatably by bending a lock piece 22*b* provided on its outer periphery into the lock hole 10*e* made in the bearing section lob. The washer 21 may be produced of a synthetic resin such as nylon, fiber, or a metal such as stainless steel. The friction washer may be replaced with one produced of a wear-resisting material such as stainless steel.

On the friction washer 22 side an elastic means 23 comprised of a spring washer and a plain washer 24 is mounted, with the rotating shaft 20*a* inserted into the insertion holes 23*a* and 24*a* made at the center of these washers; the elastic means 23 is pressed into contact with the non-rotating friction washer 22 through the plain washer 24 by staking the end portion of the rotating shaft 20*a* to a specific staking torque.

The second friction mechanism 26 comprises the friction washer 22 secured to the bearing section 10*a* of the mounting member 10, with the second rotating shaft 20*a* inserted into the insertion hole 22*a*; and the elastic means 23 composed of an axially slidable spring washer which is mounted on the second rotating shaft 20*a*, and pressed into contact with the friction washer 22, and can rotate with the second rotating shaft 20*a*.

When the opening-closing body 3 is in the closed position, the teeth of the driven gear 20 face the non-toothed portion 14*b* of the main driving gear 14, and therefore during the initial period of operation the driven gear 20 will not mesh with the main driving gear 14 through the specific angle of opening (10 degrees in the embodiment) from the opened position of the opening-closing body 3. However, the gears come into mesh with each other at the specific angle of opening, applying the friction torque generated by the second friction mechanism 26 on the driven gear 20 side to the first rotating shaft 13 through the main driving gear 14.

This signifies that when the opening-closing body 3 is closed, the driven gear 20 and thy main driving gear 14 are out of engagement at the specific angle of closing (10 degrees in the embodiment), and that the friction torque generated by the second friction mechanism 26 on the driven gear 20 side will not be exerted to the first rotating shaft 13.

The main driving gear 14 is provided with a stopper portion 14*c* formed of a deformed tooth section, which prevents engagement of the main driving gear 14 with the driven gear 20 when the main driving gear 24 is at a specific angle of rotation, thus restricting the angle of rotation of the first rotating shaft 13, that is, the angle of opening of the opening-closing body 3, to a predetermined angle. The maximum angle of rotation (the maximum angle of opening of the opening-closing body 3) is 175 degrees from the closed position 0 degree in the embodiment. Over this angle of rotation, the first rotating shaft 13 is checked from rotating by the stopper section 14*c*.

Although preferred embodiments of the present invention have been described and illustrated herein it will be understood that the present invention is susceptible to various modifications and adaptations within the true spirit and scope of the appended claims.

What is claimed is:

1. A tilt hinge, comprising: a mounting member adapted to be attached on an apparatus body;

a first rotating shaft rotatably mounted on a bearing section of said mounting member, said first rotating shaft being adapted for supporting an opening-closing body for turning with an opening-closing operation of the opening-closing body;

a main driving gear mounted to turn together with said first rotating shaft;

a first friction mechanism engaged with said first rotating shaft for resisting rotation of said first rotating shaft;

a second rotating shaft rotatably mounted on said bearing section of said mounting member;

a driven gear mounted in mesh with said main driving gear to rotate together with said second rotating shaft; and a second friction mechanism engaged with said second rotating shaft for resisting rotation of said second rotating shaft.

2. A tilt hinge, comprising:

a mounting member adapted to be attached on an apparatus body;

a first rotating shaft rotatably mounted on a bearing section of said mounting member, said first rotating shaft being adapted for supporting an opening-closing body for turning with an opening-closing operation of the opening-closing body;

a main driving gear mounted to turn together with said first rotating shaft;

a first friction mechanism and a click stop means engaged with said first rotating shaft for resisting rotation of said first rotating shaft and for generating a click effect when the first rotating shaft rotates;

a second rotating shaft rotatably mounted on said bearing section of said mounting member;

a driven gear mounted in mesh with said main driving gear to rotate together with said second rotating shaft; and a second friction mechanism engaged with said second rotating shaft for resisting rotation of said second rotating shaft.

3. A tilt hinge according to claim 1 or 2, wherein said first friction mechanism comprises a stationary cam member secured on said bearing section of said mounting member, said bearing section having a bearing holes, said first rotating shaft being rotatably inserted in said bearing hole, an axially slidable rotating cam member which is mounted on said first rotating shaft, in contact with said stationary cam member, thus rotating together with said first rotating shaft, and an elastic means mounted on said first rotating shaft to press said rotating cam member toward said stationary cam member side.

4. A tilt hinge according to claim 1 or 2, wherein said second friction mechanism comprises a friction washer which is secured on said bearing section of said mounting member, said bearing section having a bearing hole, said second rotating shaft being rotatably inserted into said bearing hole, and an axially slidable spring washer mounted on said second rotating shaft, in contact with said friction washer, and rotating together with said rotating shaft.

5. A tilt hinge according to claim 1 or 2, wherein said main driving gear comprises one having a non-toothed section; said main driving gear being engaged with said driven gear to thereby restrict the range of rotation of said driven gear to the range of specific angle of rotation of said main driving gear.

6. A tilt hinge according to claim 1 or 2, wherein said main driving gear has a stopper section which restricts the range of rotation of the driven gear in mesh with said main driving gear to the range of specific angle of rotation of said main driving gear.

7. A tilt hinge according to claim 2, wherein said click stop means comprises a recess section provided in a stationary cam member secured on said bearing section, a projection section provided on a rotating cam member mounted on said first rotating shaft, said projecting section fits in said recess section for rotation in a predetermined angle with respect to said recess section, and an elastic means for pressing said rotating cam member to engage with said stationary cam member.

8. A tilt hinge according to claim 5, wherein said elastic means is composed of a plurality of disk springs which are mutually superposed.

* * * * *